US008322292B2

(12) United States Patent
Chen

(10) Patent No.: US 8,322,292 B2
(45) Date of Patent: Dec. 4, 2012

(54) OBJECT HOLDING TABLE

(75) Inventor: Stephen Chen, Changhua (TW)

(73) Assignee: E-Lead Electronic Co., Ltd., Changhua (TW)

( * ) Notice: Subject to any disclaimer, the term of this patent is extended or adjusted under 35 U.S.C. 154(b) by 77 days.

(21) Appl. No.: 12/929,402

(22) Filed: Jan. 21, 2011

(65) Prior Publication Data

US 2012/0186499 A1 Jul. 26, 2012

(51) Int. Cl.
*A47B 23/00* (2006.01)

(52) U.S. Cl. ..... 108/43; 108/44; 248/463

(58) Field of Classification Search ..... 108/43, 108/44, 45, 115, 3, 1, 2, 131, 132, 133; 248/463, 248/454, 537, 460
See application file for complete search history.

(56) References Cited

U.S. PATENT DOCUMENTS 1,598,569 A * 8/1926 Fitzhugh ..... 108/49
2,690,942 A * 10/1954 Marcus ..... 108/18
3,095,833 A * 7/1963 Peter ..... 108/3
5,377,946 A * 1/1995 Pannu ..... 248/456
5,713,548 A * 2/1998 Boyer et al. ..... 248/205.2
6,152,417 A * 11/2000 Randall ..... 248/460
2003/0079661 A1* 5/2003 Luu ..... 108/116
2003/0230222 A1* 12/2003 Liu ..... 108/50.01
2004/0094686 A1* 5/2004 Hsien ..... 248/537
2011/0200219 A1* 8/2011 Vizcarra et al. ..... 381/332
2012/0026663 A1* 2/2012 Costamagna ..... 361/679.22
2012/0060724 A1* 3/2012 Doss et al. ..... 108/43

* cited by examiner

*Primary Examiner* — Jose V Chen
(74) *Attorney, Agent, or Firm* — Guice Patents PLLC

(57) ABSTRACT

An object holding table comprising a table top, a frame body, two rotating shaft sets and a foot stand set. The rotating shaft sets are used to movably attach the table top and the frame body to allow the table top to turn 90 degrees. The foot stand set has a first lateral foot stand and a second lateral foot stand both capable of overturning outwards and supporting the object holding table to stand; and when not in use, to withdraw and being stored at the inner side of the table top. By assembling the foregoing assemblies, the object holding table of the present invention is hence capable of holding a portable electronic device and turning 90 degrees to reach a convenient watching position.

13 Claims, 14 Drawing Sheets

OBJECT HOLDING TABLE

BACKGROUND OF THE INVENTION

1. Field of the Invention

The present invention relates to an object holding table, more particularly, to an object holding table that is capable of holding a portable electronic device and turning 90 degrees to reach a convenient watching position.

2. Brief Description of the Related Art

Owing to the popularization of the computers, almost every family has at least one computer. However, the traditional desktop computers are not portable because of their size; moreover, they take up much space, which is a crucial defect in the modern society. Hence, the portable laptops are widely used. The laptops can be used in beds, cars, or even on the floor; nevertheless, there is still problems during use such as there is no appropriate holder (such as a table) to contain and support the laptops, and therefore when users spend a long time watching the screen, exhaustion is very likely to appear. Please refer to the prior art 1 of Taiwan patent (No. TW M363839), as illustrated in FIG. 1. The structure comprises: a table body 111, a table board 112 and four supporting table legs 113, wherein the table board 112 provides a space to hold the laptop and is capable of adjusting its angle. However, it has its defect, that is: the adjustable angle of the table board 112 has a limited range since it does not contain a structure to secure the laptop. This defect appears to be bothering especially when there are two or more people trying to watch the laptop screen at the same time; it is difficult and time-consuming to adjust the laptop to an appropriate angle and to synchronously adjust the four supporting table legs 113 to the same height.

The prior art 2 of another Taiwan patent (No. TW M380054), as illustrated in FIG. 2, disclosed a structure comprising a table body 121, a cover-lifting table board 122 and two table legs 123; wherein the structure is mainly identical to the prior art 1 and is capable of adjusting the angle of laptop placed thereon by the cover-lifting table board 122. However, there is also a structural limit causing the bigger-angle adjustment impossible. The advantage of the prior art 2 is the two table legs 123 that help with the adjustment and therefore slightly better than the prior art 1.

Similar laptop holding table structures can be seen in many Taiwan patents, such as No. M352877, No. M337773, No. M536113, No. M276493, No. M307335 and No. M336463. The foregoing prior arts of the laptop holding table structures (hereinafter the prior arts), however, are with the below deficiencies:

1. The prior arts are of large size and weight;
2. The adjusting structure of the prior arts comprises many assembling components, and are therefore of high costs and inconvenient and complicated to operate;
3. When there are many people watching the one laptop at the same time, the ideal angle thereof would be a vertical angle; however, the structure of the prior arts lacks the securing structure and therefore unable to adjust too much or the laptop is very likely to fall out from the table. Hence there is often blind spots and reduce the watching quality.

SUMMARY OF THE INVENTION

In order to overcome the deficiencies of the preceding prior art, a primary object of the present invention is to provide an object holding table that is capable of holding a portable electronic device and turning 90 degrees to reach a convenient watching position.

With the above object in mind, the present invention provides an object holding table comprising a table top, a frame body, two rotating shaft sets and a foot stand set; wherein the rotating shaft sets are used to movably attach the table top and the frame body to allow the table top to turn 90 degrees. The foot stand set has a first lateral foot stand and a second lateral foot stand, wherein the first lateral foot stand and the second lateral foot stand are capable of overturning outwards and therefrom supporting the object holding table to stand; and when not in use, to withdraw and being stored at the inner side of the table top. By assembling the foregoing assemblies, the object holding table of the present invention is hence capable of holding a portable electronic device and turning 90 degrees to reach a convenient watching position.

The rotating shaft set comprises a force-resisting rotating shaft and a positioning base.

The table top is disposed of an attaching part at each of its two lateral inner surfaces, wherein the attaching part is fixedly joined to the force-resisting rotating shaft.

The frame body has two sides connected with the first and second lateral foot stand respectively, wherein the first and second lateral foot stand are hence capable of overturning outwards and therefrom supporting the object holding table to stand; and when not in use, to withdraw and being stored at the inner side of the table top.

The frame body is disposed of a force-resisting rotating shaft, wherein the force-resisting rotating shaft is attached to the central part of inner side surface of the table top to allow the angle adjustment and laptop securing after said adjustment.

The frame body is further disposed of a foot stand securing base, wherein the foot stand securing base is magnetic and by its magnetic adsorption to the first foot stand, which is made of metal, the first lateral foot stand and a second lateral foot stand are hence being secured.

The foot stand securing base has a C-shaped groove, wherein the C-shaped groove is used to limit the first foot stand and thereby secures the stored first and second foot stands.

BRIEF DESCRIPTION OF THE INVENTION

The detail structure, the applied principle, the function and the effectiveness of the present invention can be more fully understood with reference to the following description and accompanying drawings, in which.

DETAILED DESCRIPTION OF THE PREFERRED EMBODIMENTS

Figure 1:
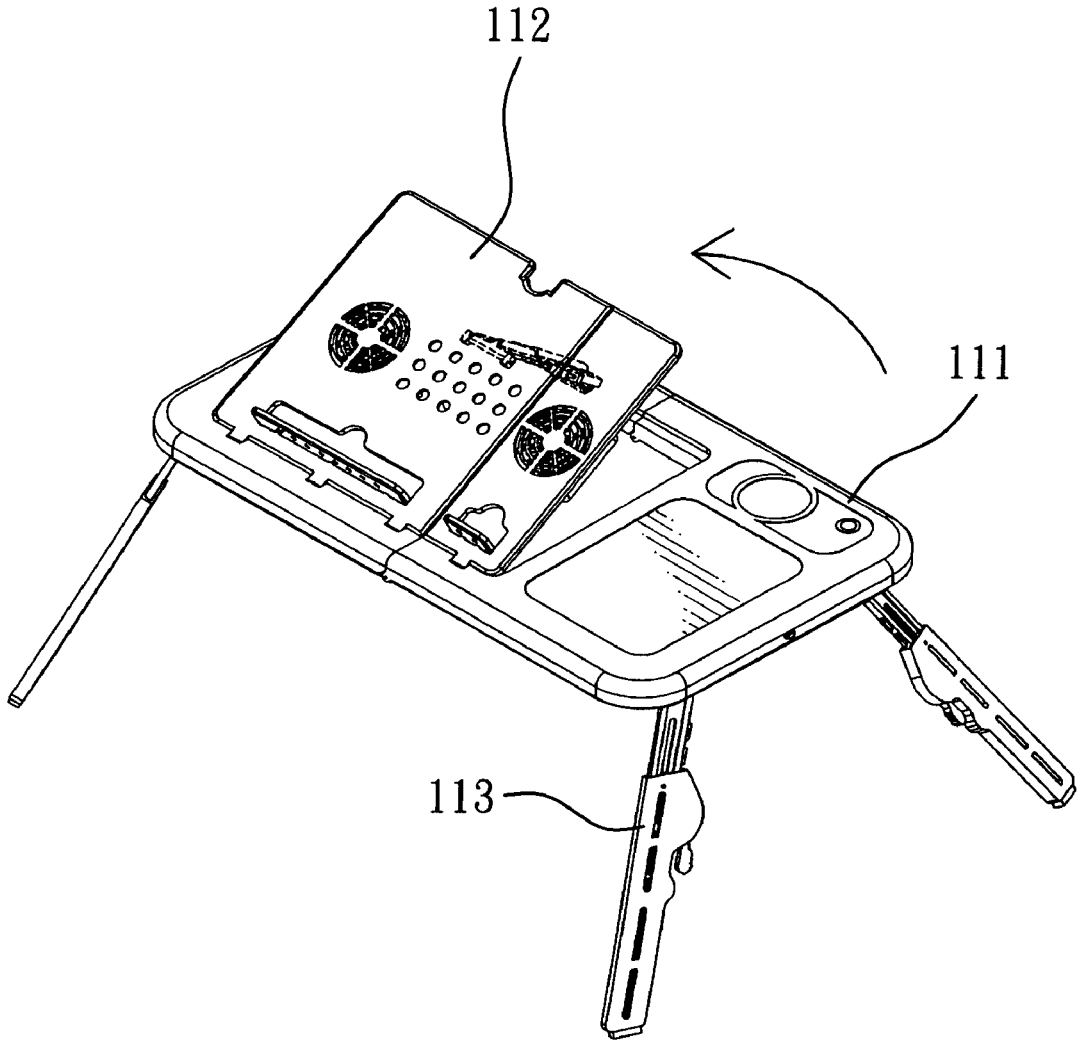
FIG. 1 PRIOR ART
FIG. 1 is a perspective view according to a prior art.
Figure 2:
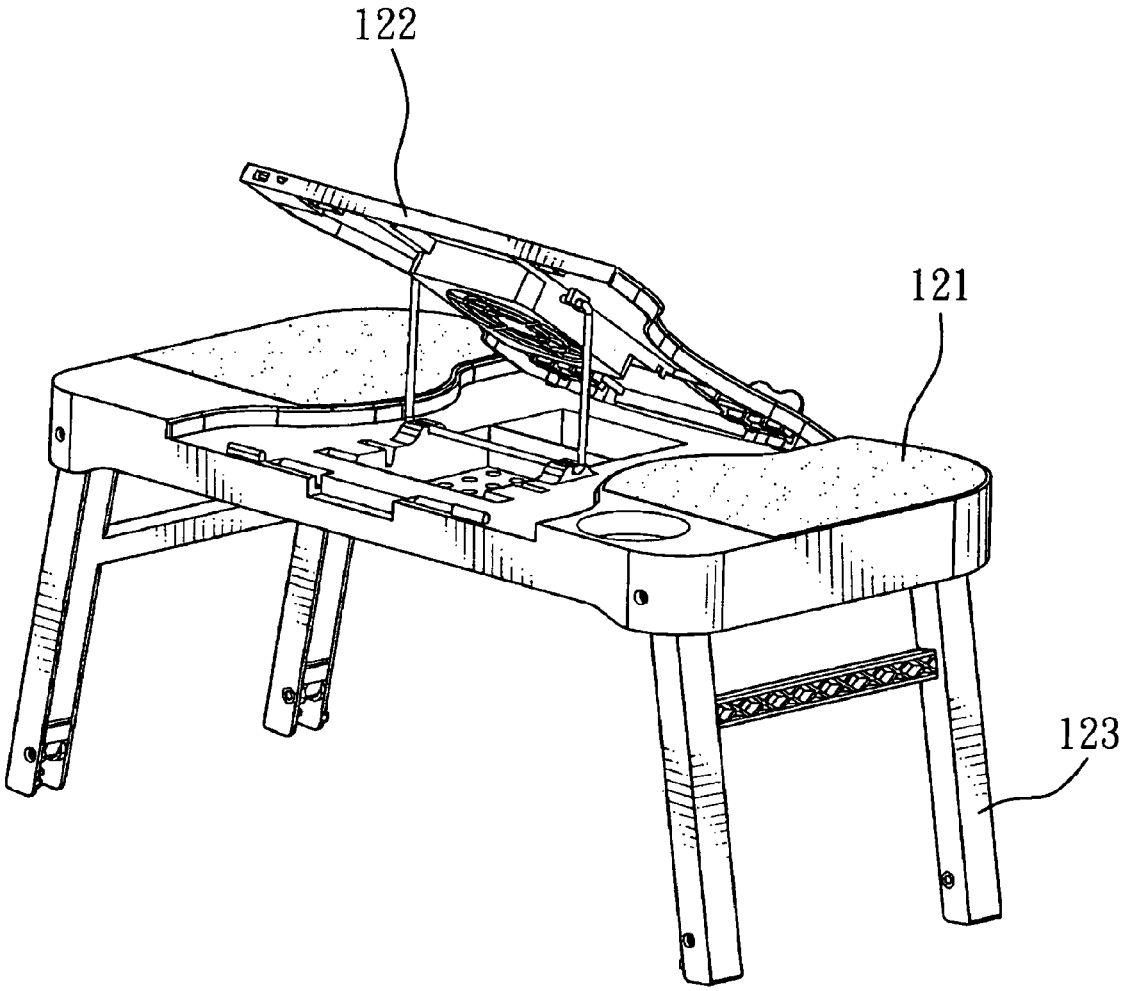
FIG. 2 PRIOR ART
FIG. 2 is a perspective view according to another prior art.
Figure 3:
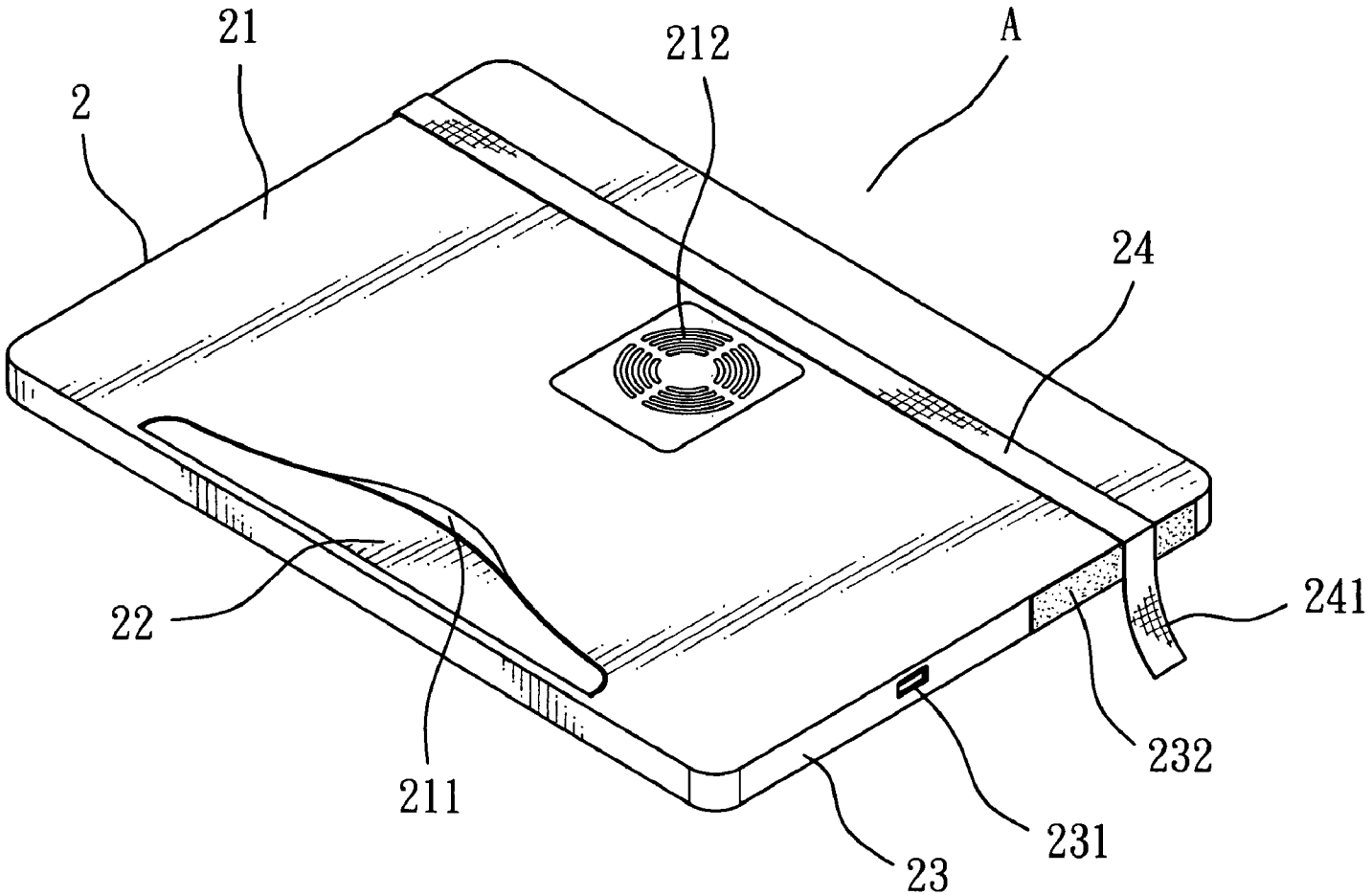
FIG. 3 is a perspective view according to the present invention.
Figure 4:
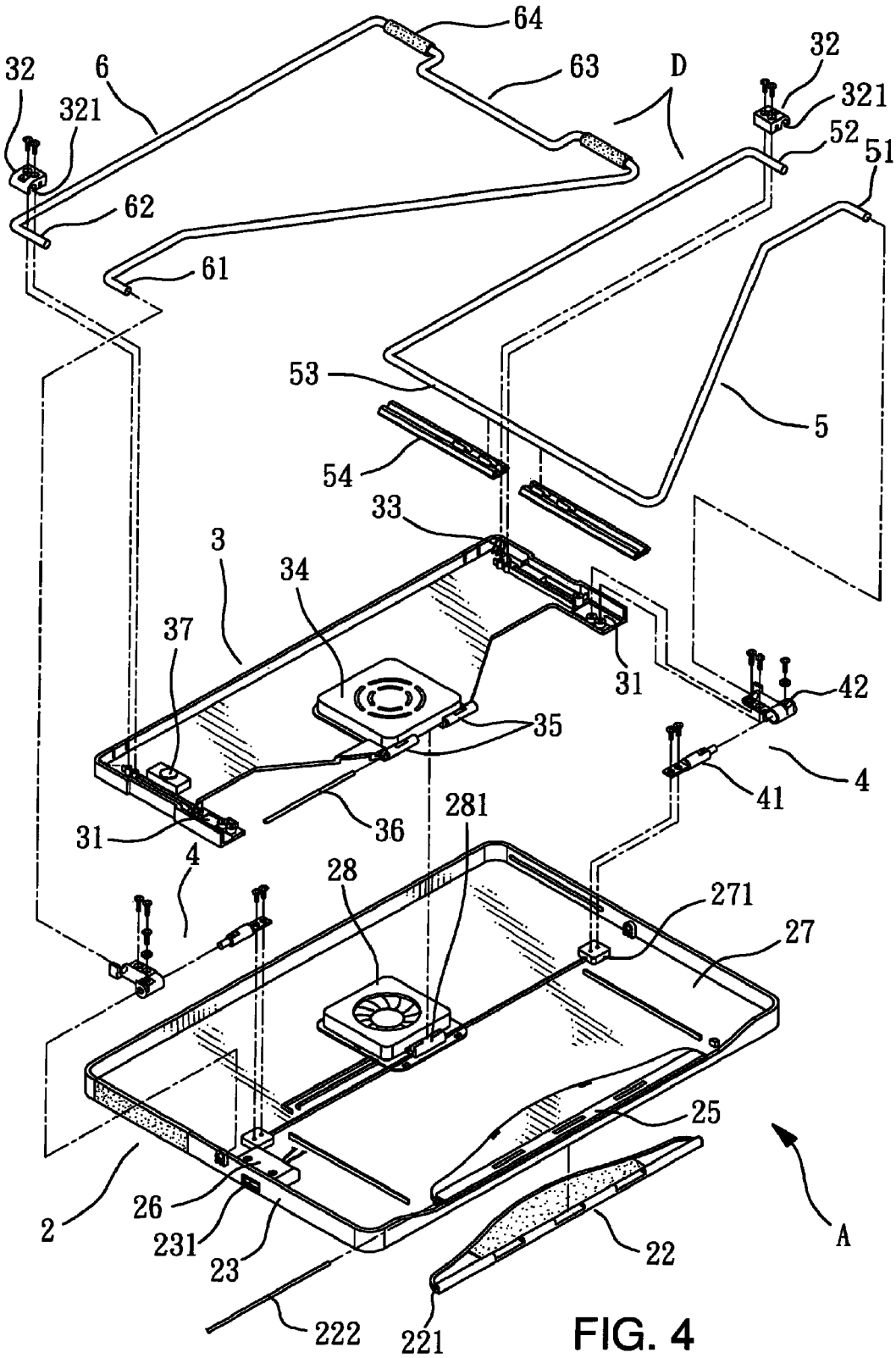
FIG. 4 is an exploded perspective view according to the present invention.
Figure 5:
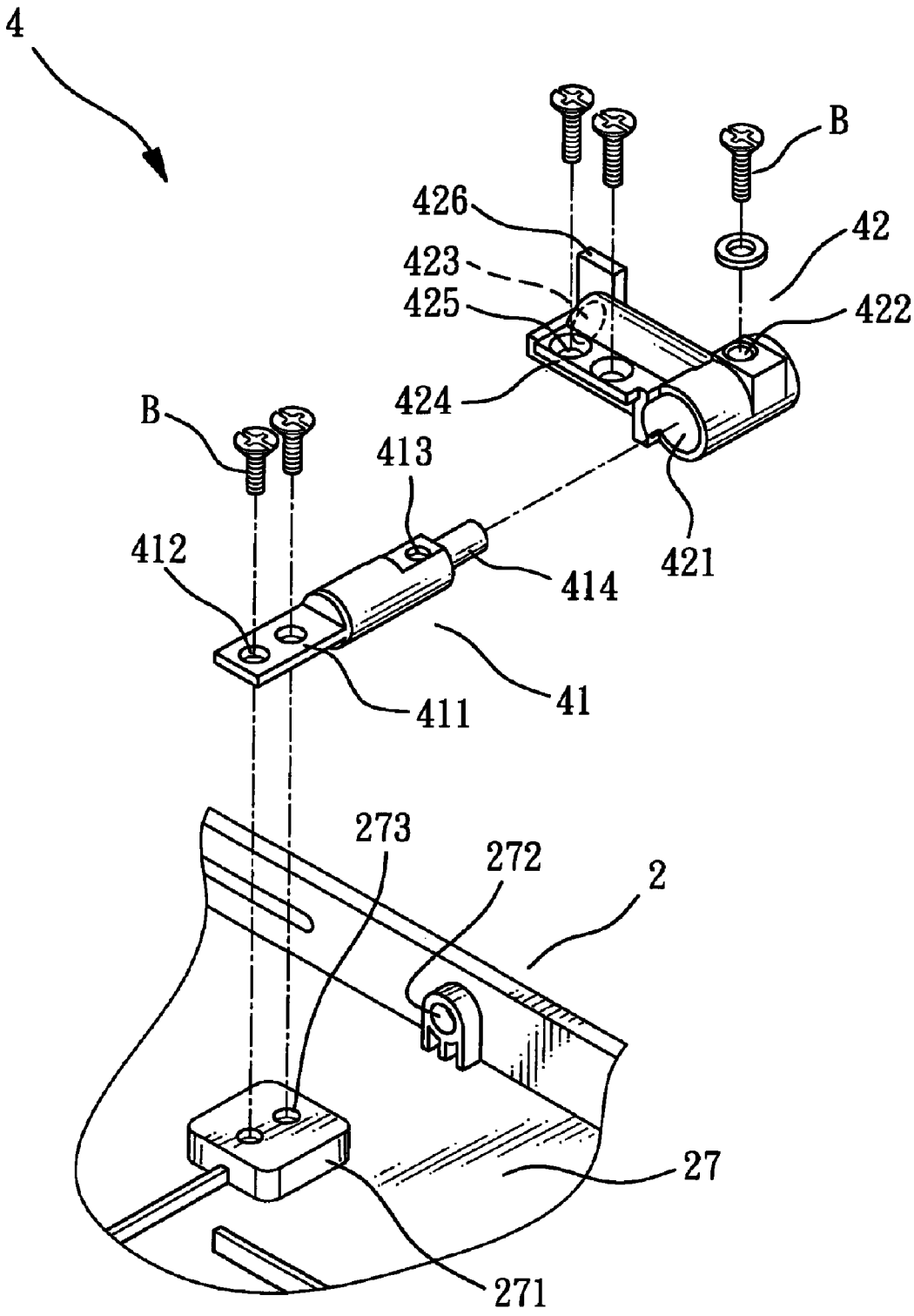
FIG. 5 is an exploded perspective view of the rotating shaft set according to the present invention.
Figure 6:
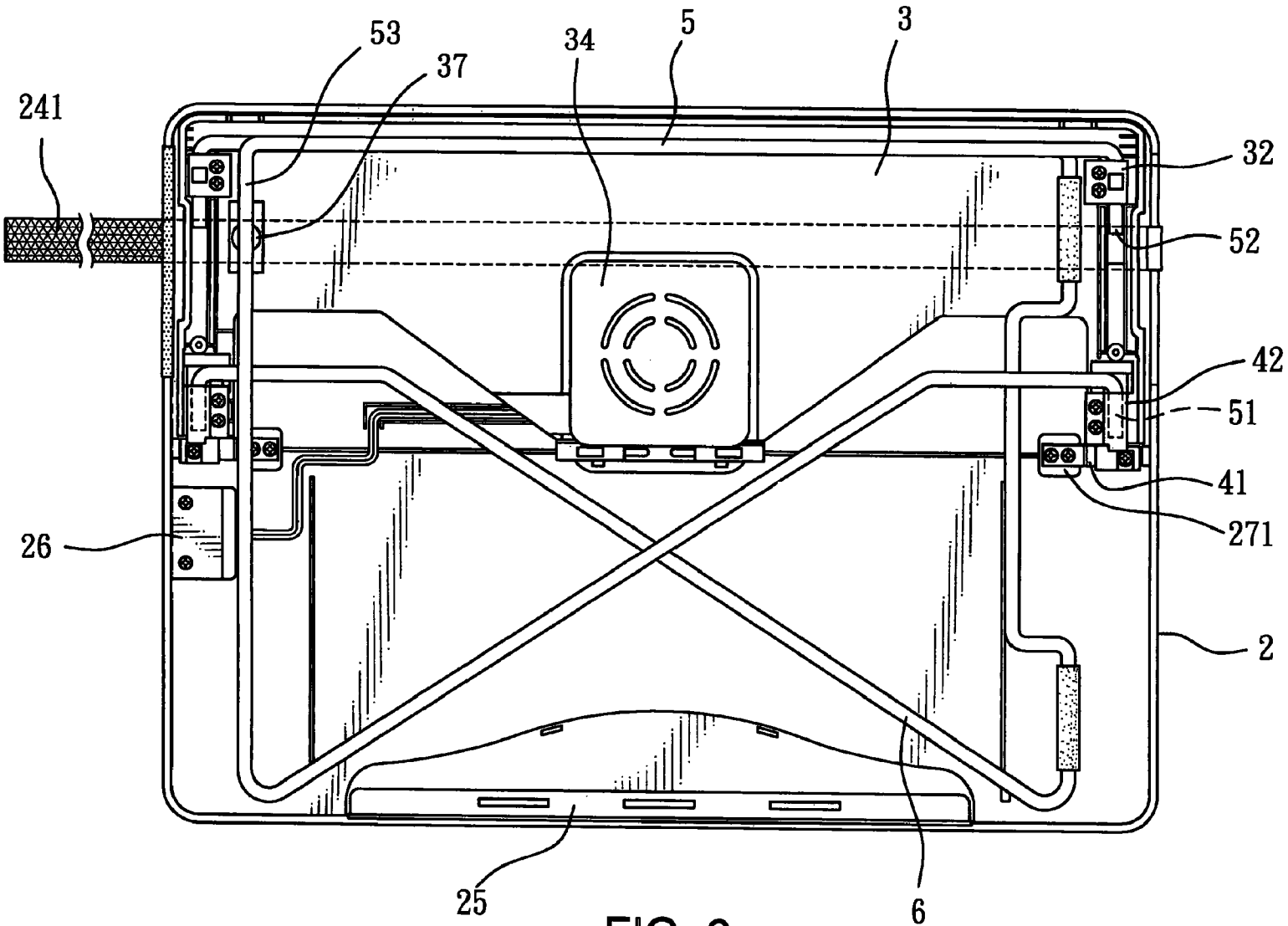
FIG. 6 is an assembled plain view according to the present invention.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

Please refer to FIGS. 3, 4, 5, 6, and 11, wherein the object holding table A of the present invention comprises a table top 2, a frame body 3, two rotating shaft sets 4 and a foot stand set D.

The table top 2 has a front surface 21 to contain the portable electronic device 7; wherein a receiving groove 211 is concavely disposed at a lower side of the front surface 21 and at least one ventilation aperture 212 is disposed at the front surface 21. One side of the table top 2 is joined to one end of a band body 24, and the other side of the table top 2 is disposed of a USB jack 231 and a band body securing part 232; wherein inner side of the USB jack 231 is connected to a socket 26 to provide the electricity for a heat dissipating fan 28, and the band body securing part 232 adhesively buckles and fixes a free end 241 of the band body 24. Inner side 27 of the table top 2 further provides a first shaft seat 25 to movably attach to a second shaft seat 221 on the bottom of a supporting board 22; and by the insertion of the first fulcrum 222, shaft center of the supporting board 22 is therefore determined. The inner side 27 has an attaching part 271 and a hole base 272, wherein the attaching part 271 has at least one threaded hole 273 and the heat dissipating fan 28 is disposed thereon corresponding to the ventilation aperture 212. A third shaft seat 281 is disposed at the center of the inner side 27 of the table top 2.

The frame body 3 is disposed at upper section of the inner side 27 of the table top 2, wherein two sides of the frame body 3 respectively provides a first positioning platform 31 and a second positioning platform 33. The second positioning platform 33 is locked to a securing base 32 with a position limiting groove 321. A casing base 34 is disposed on the frame body 3 corresponding to and containing the heat dissipating fan 28. At least one fourth shaft seat 35 is disposed at lower edge of the frame body 3, wherein the fourth shaft seat 35 is movably attached to the third shaft seat 281 to allow insertion of a second fulcrum 36 and shaft center of the table top 2 is therefore determined. One side of the frame body 3 further provides a foot stand securing base 37, wherein the foot stand securing base is magnetic.

The rotating shaft set 4 is used to connect the table top 2 and the frame body 3. The rotating shaft set 4 comprises parts described hereinafter.

A force-resisting rotating shaft 41, wherein one end of the force-resisting rotating shaft 41 provides a flat board 411 locked to the attaching part 271. The flat board 411 has at least one through hole 412. Another end of the force-resisting rotating shaft 41 has a threaded hole 413 and an end shaft 414.

A positioning base 42, wherein one side of the positioning base 42 has a lateral shaft hole 421 to allow the insertion of the end shaft 414 of the force-resisting rotating shaft 41 and thereby limits the position of the hole base 272. The lateral shaft hole 421 has a through hole 422 on the top edge thereof to contain a threaded bolt B and thereby being able to be locked to the threaded hole 413 of the force-resisting rotating shaft 41. The center of the positioning base 42 has a vertical shaft hole 423 and a platform 424, wherein one end of the vertical shaft hole 423 is disposed of a protruding plate 426, and the platform 424 is disposed of at least one through hole 425 in correspondence to the at least one threaded bolt B, and thereby being able to be locked to the first positioning platform 31.

The foot stand set D disposed at the bottom of the frame body 3 comprises parts described hereinafter.

A first lateral foot stand 5, wherein one side of the first lateral foot stand 5 has a first foot end 51 and a second foot end 52. The first foot end 51 is disposed inside the vertical shaft hole 423 of the positioning base 42 of one of the rotating shaft set 4. The second foot end 52 is disposed inside the position limiting groove 321 of one of the second positioning platform 33 that is locked to the securing base 32. Another side of the first lateral foot stand 5 is disposed of a lateral bar 53, and a securing board 54 is surrounding the lateral bar 53.

A second lateral foot stand 6, wherein one side of the second lateral foot stand 6 has a third foot stand 61 and a fourth foot stand 62. The third foot stand 61 is disposed inside the vertical shaft hole 423 of the positioning base 42 of the other rotating shaft set 4. The fourth foot stand 62 is disposed inside the position limiting groove 321 of the other second positioning platform 33 that is locked to the securing base 32. Another side of the second lateral foot stand 6 is disposed of a lateral bar 63, and a pad body 64 is set surrounding the lateral bar 63.

Figure 7:
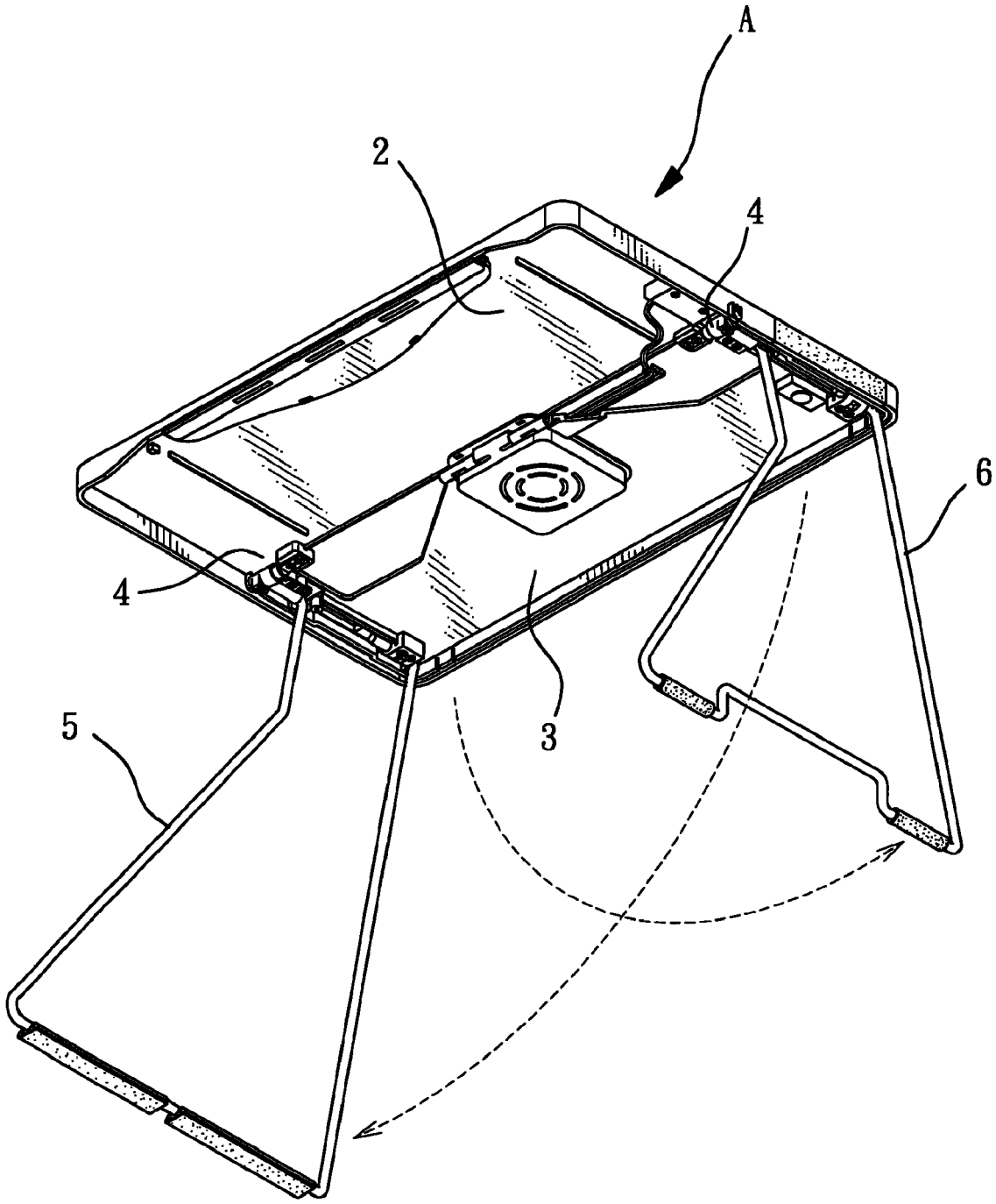
FIG. 7 is an expanded view according to the present invention.
Figure 8:
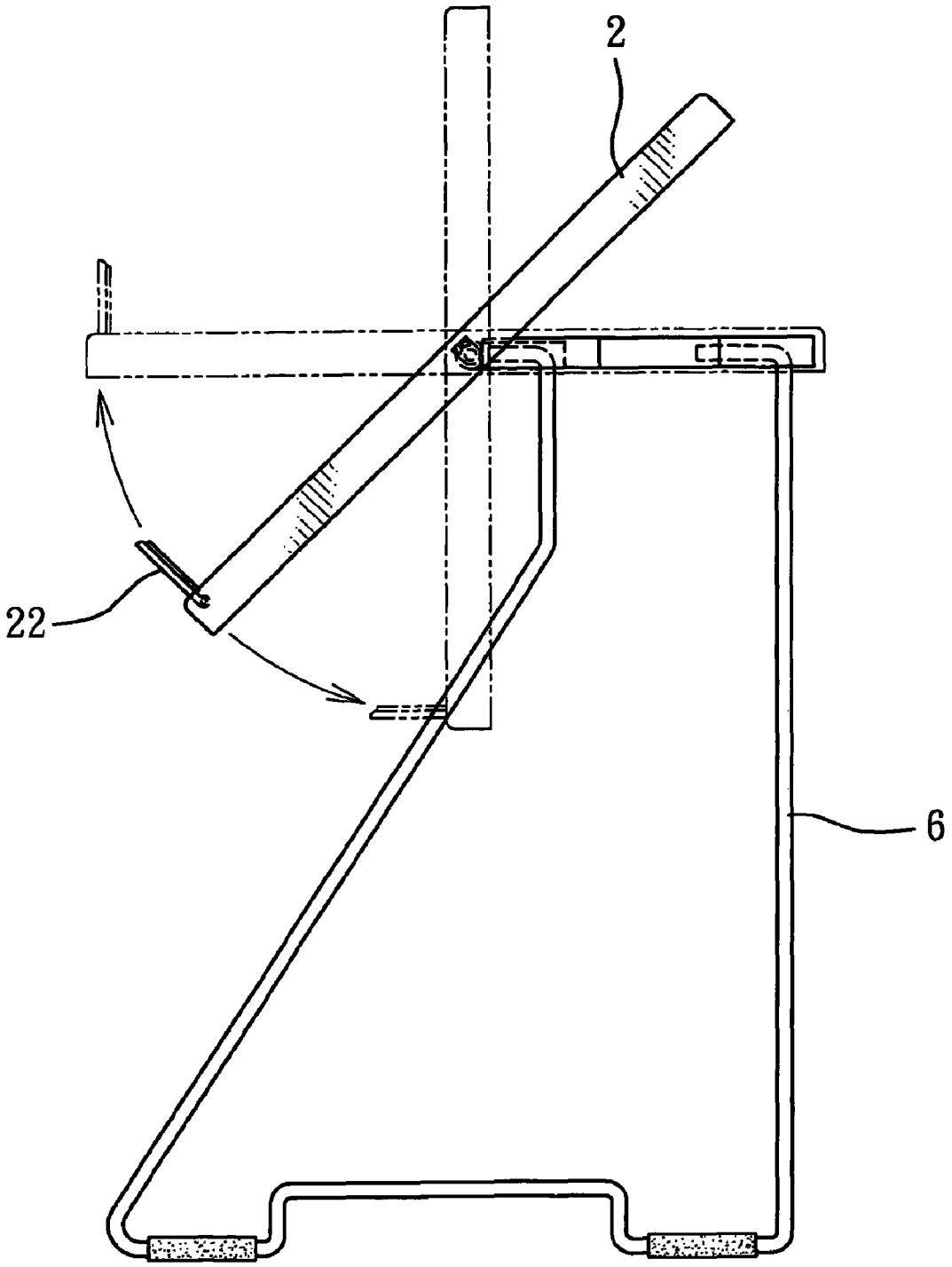
FIG. 8 is an operating representation according to the present invention.
Figure 9:
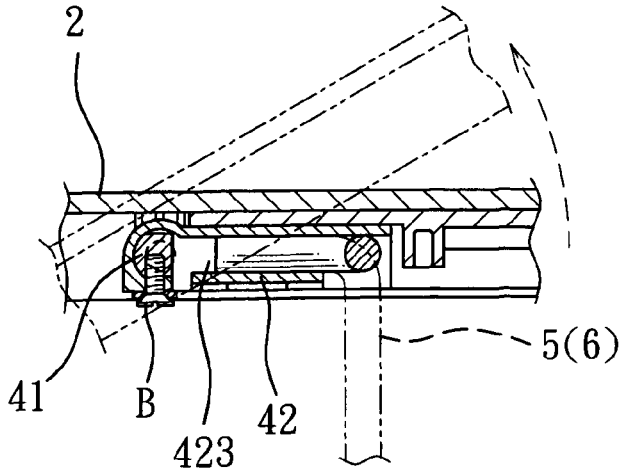
FIG. 9 is a sectional operating representation according to the present invention.
Figure 10:
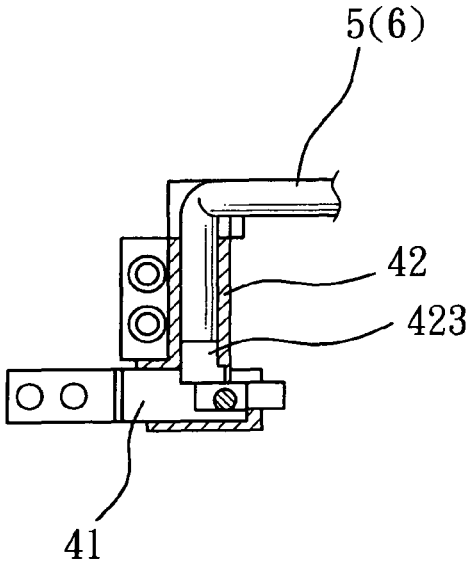
FIG. 10 is a sectional expanded view according to the present invention.
Figure 11:
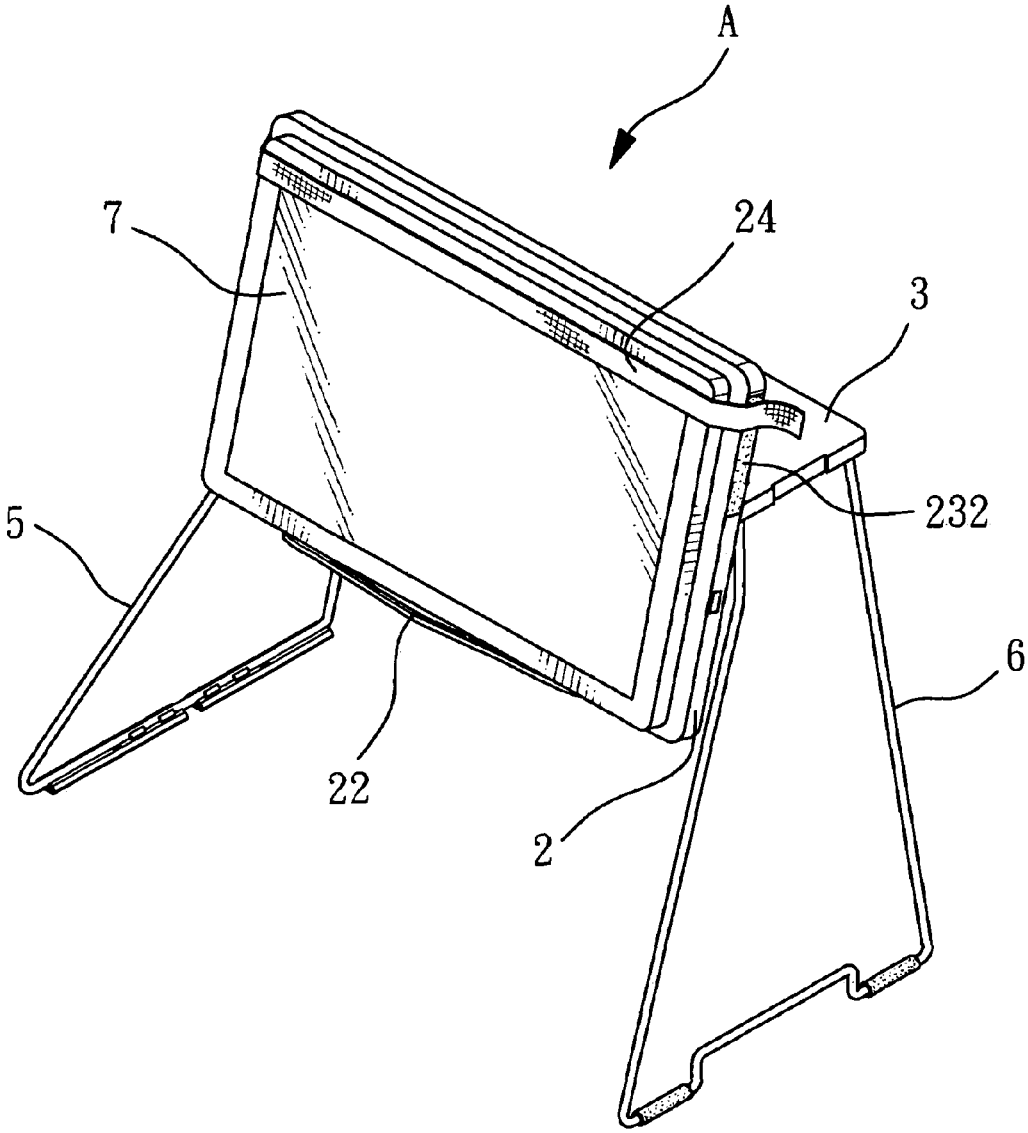
FIG. 11 is a schematic representation of an embodiment according to the present invention.
Figure 12:
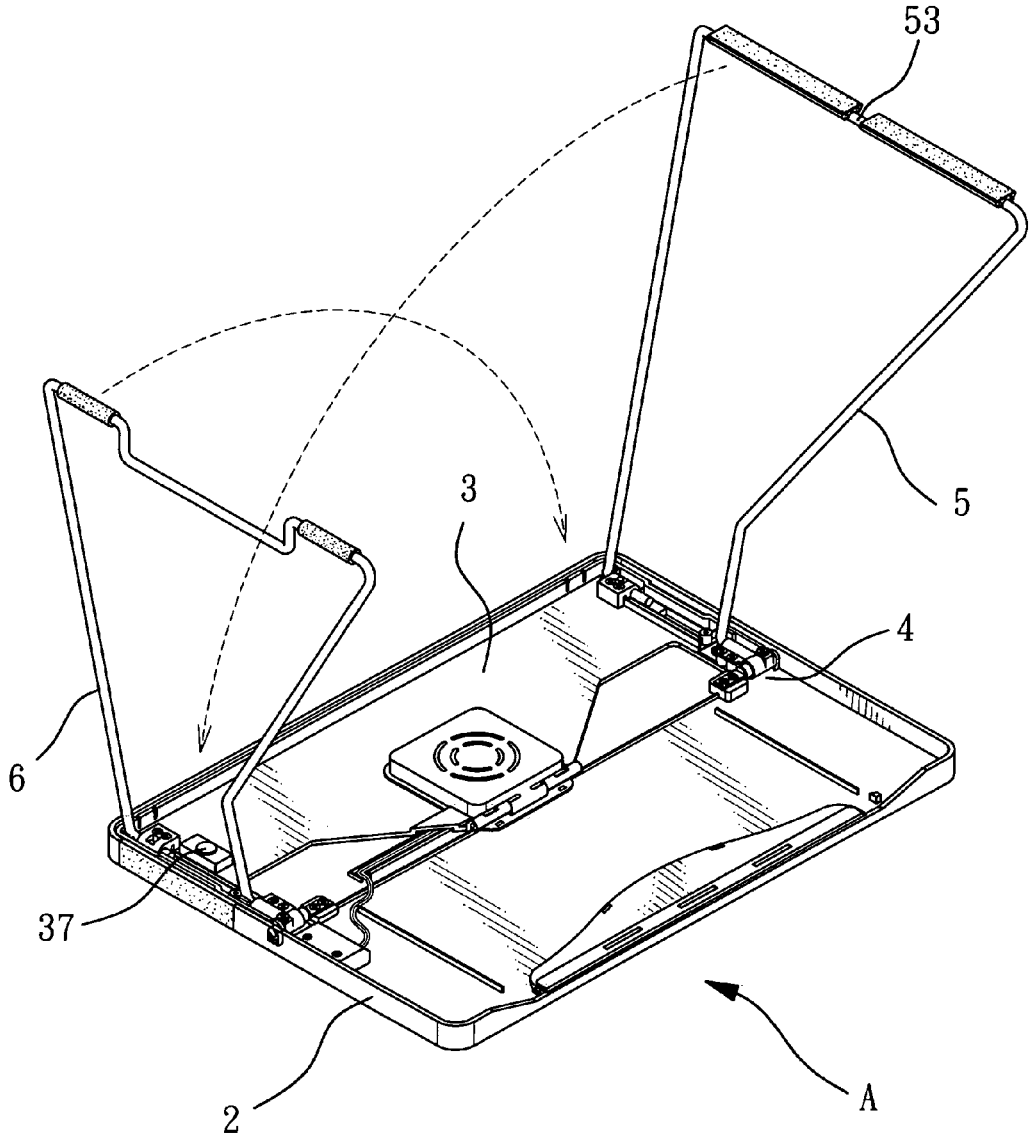
FIG. 12 is schematic representation of a storing status according to the present invention.
Figure 13:
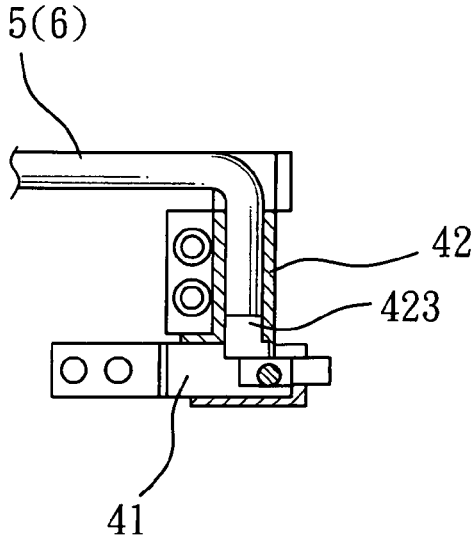
FIG. 13 is a sectional view of a storing status according to the present invention.

To set up the object holding table A assembled by the foregoing components, firstly is to turn the first lateral foot stand 5 and the second lateral foot stand 6 outwards, as shown in FIGS. 7 and 10. And then to turn the table top 2 to a predetermined angle using the force-resisting rotating shaft 41 as fulcrum; the biggest turning angle is 90 degrees, as shown in FIGS. 8, 9 and 11. Turn over the supporting board 22 until it's of a vertical position in respect to the table top 2 to provide support when the portable electronic device 7 is placed on the table top 2. Buckles the portable electronic device 7 with the band body 24 and adhesively buckles and fixes the free end 241 of the band body 24 to the band body securing part 232. Moreover, when not in use, firstly to detach the portable electronic device 7 from the object holding table A, then return the supporting board 22 to its original position inside the receiving groove 211. And then repeat the foregoing steps in an opposite manner: turn the second lateral foot stand 6 and the first lateral foot stand 5 inwards, as illustrated in FIGS. 12 and 13. Since the first lateral foot stand 5 has the lateral bar 53 that is magnetic, the magnetic adsorption thereof allows it to be secured to the foot stand securing base 37 and thereby limits the position of the first lateral foot stand 5 and further secures the position of both the second lateral foot stand 6 and the first lateral foot stand 5 while in storage.

The force-resisting rotating shaft 41 has a rotating resisting force, therefore no matter what angle it is turned to, as long as there is no external force applied thereon that is larger than the rotating resisting force, it is capable of retaining the same position. The advantage is that the table top 2 is able to be adjusted to any angle within the range of 0-90 degrees.

Figure 14:
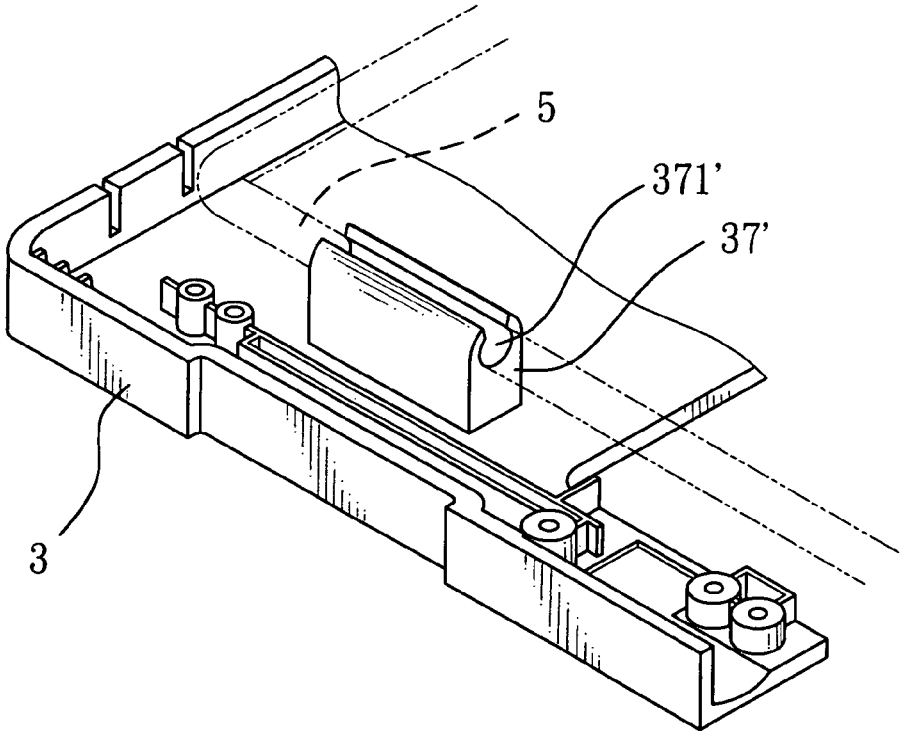
FIG. 14 is a sectional perspective view of another embodiment according to the present invention.
Figure 15:
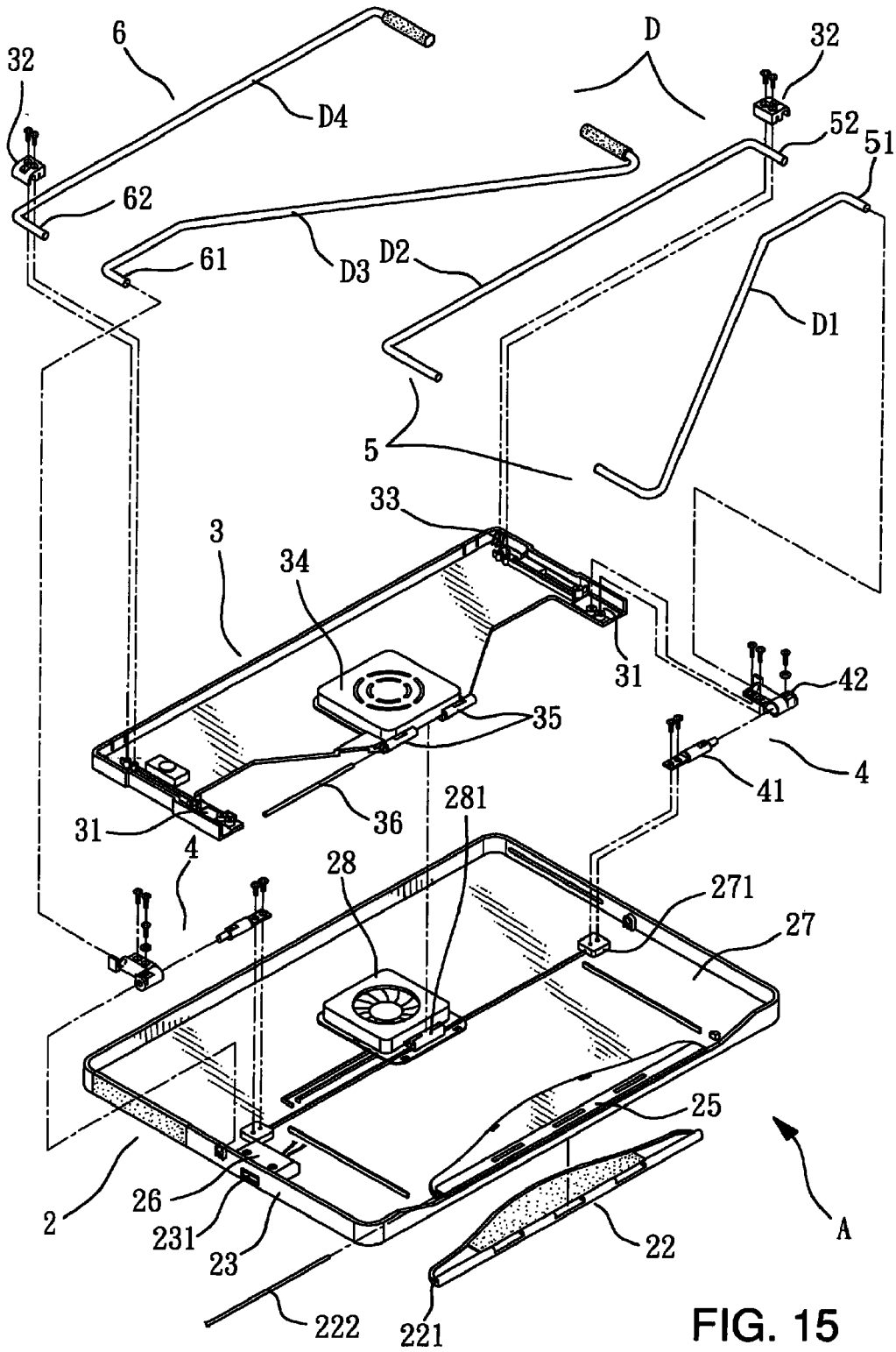
FIG. 15 is an exploded perspective view of another embodiment according to the present invention.
Figure 16:
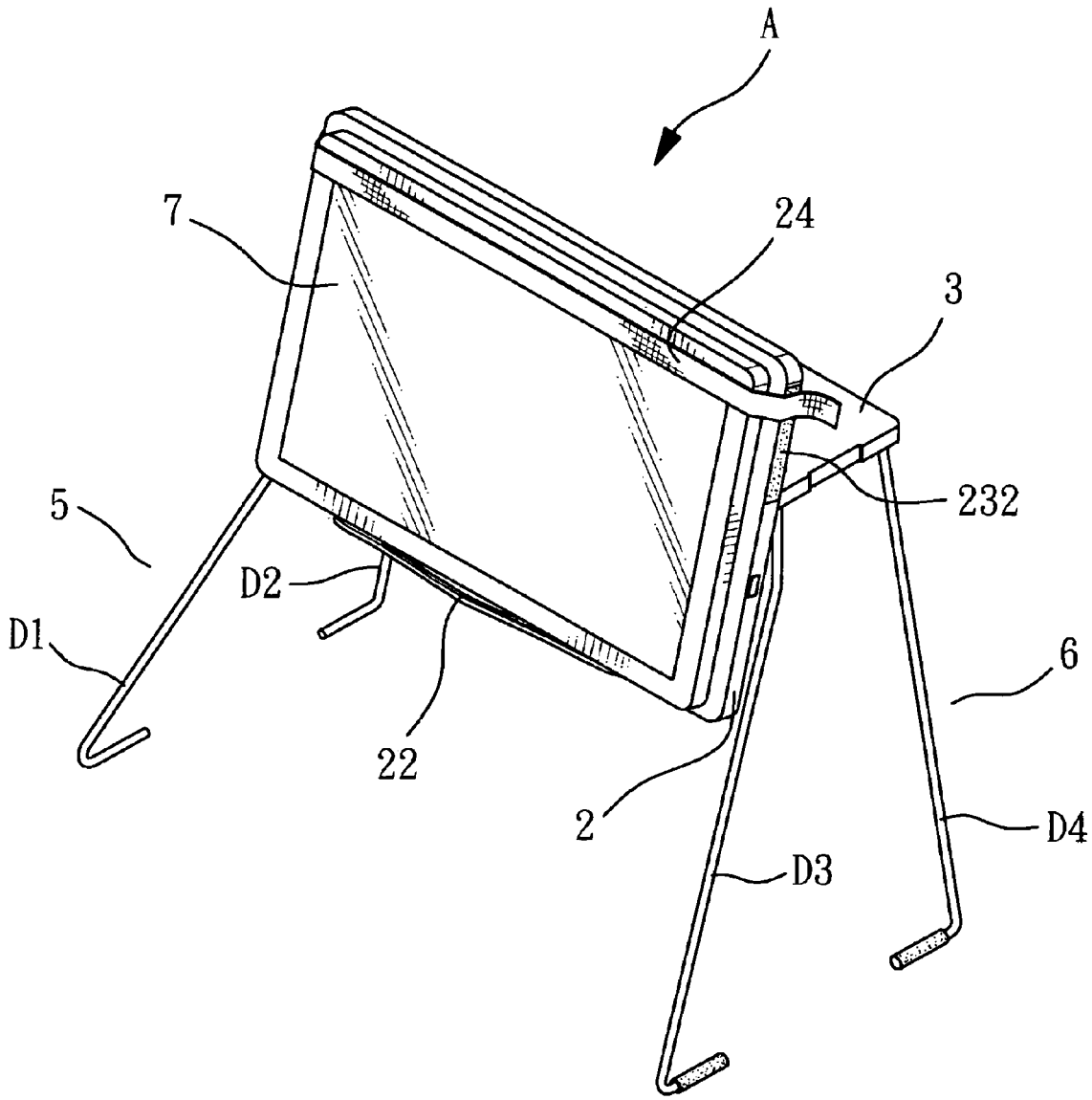
FIG. 16 is a perspective view of another embodiment according to the present invention.

Please refer to FIG. 14, another embodiment of the present invention; wherein the foot stand securing base 37' has a C-shaped groove 371'. The foot stand securing base 37' is made of plastic material and is therefore capable of allowing the lateral bar 53 of the first lateral foot stand 5 to be embedded and stored therein. And the -shaped groove is thereby further capable of limiting the position of the first lateral foot stand 5 and secures the first lateral foot stand 5 and the second foot stand 6 while in storage. Referring to FIGS. 15 and 16, another embodiment of the present invention; wherein the first lateral foot stand 5 and the second lateral foot stand 6 are each formed by two supporting frames respectively: D1, D2, D3 and D4. Wherein, the four supporting frames D1, D2, D3 and D4 are capable of overturning outwards and therefrom supporting the object holding table A to stand; and when not in use, to withdraw and being stored at the inner side 27 of the table top 2.

While the invention has been described with reference to a preferred embodiment thereof, it is to be understood that modifications or variations may be easily made without departing from the spirit of this invention, which is defined in the appended claims.

I claim:

1. An object holding table for a portable electronic device comprising:

a table top having a front surface to contain the portable electronic device;

a frame body located on an inner side of the table top and pivotally connected to the table top;

two rotating shaft sets including a first rotating shaft set and a second rotating shaft set, each of the two rotating shaft sets comprising a force-resisting rotating shaft resisting a movement of the table top relative to the frame body and a positioning base, wherein the two rotating shaft sets pivotally connecting the table top to the frame body;

a foot stand set having at least one first lateral foot stand and at least one second lateral foot stand, wherein the foot stand set is located on a bottom of the frame body, the at least one first lateral foot stand and the at least one second lateral foot stand are movable between an open position and a closed position;

each of a first side and a second side of the frame body has a first positioning platform and a second positioning platform; a securing base having a position limiting groove is connected to the second positioning platform of each of the first side and the second side of the frame body;

a first end of each force-resisting rotating shaft of each of the two rotating shaft sets has a flat board connected to a corresponding attaching part of two attaching parts located on an inner side of the table top, and a second end of each force-resisting rotating shaft has a threaded hole and an end shaft; and one side of the positioning base of each of the two rotating shaft sets has a lateral shaft hole, the end shaft of the force-resisting rotating shaft is inserted into the lateral shaft hole of the positioning base of a corresponding rotating shaft set of the two rotating shaft sets, and a center of the positioning base has a vertical shaft hole and a platform, and the platform is connected to the first positioning platform of the frame body.

2. The object holding table as defined in claim 1, wherein at least one ventilation aperture is disposed at the front surface of the table top, and at least one heat dissipating fan is disposed at the inner side of the table top corresponding to the ventilation aperture.

3. The object holding table as defined in claim 1, wherein one side of the frame body has a foot stand securing base that is magnetic and has magnetic adsorption selectively securing the at least one first lateral foot stand in the closed position.

4. The object holding table as defined in claim 1, wherein one side of the frame body has a foot stand securing base having a C-shaped groove, when the at least one first lateral foot stand is located in the closed position, the at least one first lateral foot stand is inserted into the C-shaped grove to limit a position of the at least one first lateral foot stand in the closed position.

5. The object holding table as defined in claim 1, wherein another side of the first lateral foot stand has a lateral bar connected to at least one securing board.

6. The object holding table as defined in claim 1, wherein another side of the second lateral foot stand has a lateral bar surrounded by at least one pad body.

7. The object holding table as defined in claim 1, further comprising a supporting board having a second shaft seat located on a bottom thereof, the table top has a first shaft seat located on a bottom thereof, a first fulcrum is inserted through the first shaft seat of the table top and the second shaft seat of the supporting board pivotally connecting the supporting board to the bottom of the table top.

8. The object holding table as defined in claim 1, wherein at least one ventilation aperture is located on the front surface of the table top and at least one heat dissipating fan is located on the inner side of the table top corresponding to the ventilation aperture; one side of the table top has a USB jack to provide electricity for a heat dissipating fan.

9. The object holding table as defined in claim 1, wherein one side of the table top is joined to a first end of a band body, and another side of the table top of has a band body securing part selectively connecting to a second end of the band body.

10. The object holding table as defined in claim 1, wherein a center of the inner side of the table top has a third shaft seat and a lower edge of the frame body has at least one fourth shaft seat; a second fulcrum is inserted through the third shaft seat of the table top and the at least one fourth shaft seat of the frame body pivotally connecting the table top to the frame body.

11. The object holding table as defined in claim 1, wherein one side of the first lateral foot stand of the foot stand set has a first foot end and a second foot end; the first foot end is inserted into the vertical shaft hole of the positioning base of the first rotating shaft set, and the second foot end is inserted into the position limiting groove of the securing base connected to the second positioning platform of the first side of the frame body.

12. The object holding table as defined in claim 11, wherein one side of the second lateral foot stand has a third foot stand and a fourth foot stand; the third foot stand is inserted into the vertical shaft hole of the positioning base of the second rotating shaft set, and the fourth foot stand is inserted into the position limiting groove of the securing base connected to the second positioning platform of the second side of the frame body.

13. The object holding table as defined in claim 1, wherein the first lateral foot stand and the second lateral foot stand of the foot stand set are each formed by two supporting frames respectively; two supporting frames of the first lateral foot stand and the two supporting frames of the second lateral foot stand are movable between an open position supporting the frame body and the table top and a closed position stored at the inner side of the table top.

* * * * *